United States Patent [19]

Futagawa

[11] Patent Number: 4,523,725

[45] Date of Patent: Jun. 18, 1985

[54] APPARATUS FOR DRIVING TAPES

[75] Inventor: Toshinobu Futagawa, Tokyo, Japan

[73] Assignee: Advanced Technology Business Creation, Inc., Tokyo, Japan

[21] Appl. No.: 572,946

[22] Filed: Jan. 23, 1984

[30] Foreign Application Priority Data

Jan. 28, 1983 [JP] Japan ..... 58-12350

[51] Int. Cl.[3] ..... B65H 19/08; G11B 15/58

[52] U.S. Cl. ..... 242/58; 226/92; 242/64; 242/67.3 R; 242/74; 242/181; 352/157

[58] Field of Search ..... 242/180, 181, 58.6, 242/58, 64, 67.3 R, 195, 74, 198; 226/92; 360/95; 352/157, 158

[56] References Cited

U.S. PATENT DOCUMENTS

| | | | |
|---|---|---|---|
| 614,048 | 11/1898 | Arrowsmith | 242/64 X |
| 2,336,496 | 8/1941 | Miller | 40/89 |
| 3,081,668 | 3/1963 | Nistri | 242/195 |
| 3,134,550 | 5/1964 | Camaras | 242/181 |
| 3,524,949 | 8/1970 | Kleve | 242/181 X |
| 3,784,122 | 1/1974 | Kataoka | 242/64 X |
| 4,416,426 | 11/1983 | Cooper | 242/64 X |

FOREIGN PATENT DOCUMENTS

| | | |
|---|---|---|
| 494881 | 3/1930 | Fed. Rep. Germany . |
| 1220836 | 5/1960 | France . |
| 114181 | 8/1981 | Japan . |

*Primary Examiner*—Stuart S. Levy
*Assistant Examiner*—Lynn M. Sohacki
*Attorney, Agent, or Firm*—Louis Orenbuch

[57] ABSTRACT

A tape driving arrangement employs a plurality of tapes mounted on a drum in a manner enabling any selected tape to be positioned at a pick-up station. The free end of each tape is provided with lateral protrusions which enable the tape to be drawn through the reading zone of an input unit to a take-up reel by a mechanism that engages those lateral protrusions. That mechanism and the engaged lateral protrusions travel in paths on either side of the reading zone and thus avoid damaging the input unit. A rewind mechanism is provided to enable the tape to be rewound.

2 Claims, 5 Drawing Figures

APPARATUS FOR DRIVING TAPES

BACKGROUND OF THE INVENTION

The present invention relates to an apparatus for selectively driving tapes to select a desired tape among a plurality of tapes on which a plurality of items, information and the like (generically, referred to as "item" or "items" in the specification and claims) are recorded or stored and to position one or more items recorded on the selected tape in a predetermined station.

Since the tape driving apparatus according to the present invention can drive or move any kind of tapes, the present invention is applicable to tape driving apparatus for multi-purpose codeless input equipment used in office computers, personal computers, word-processors, Japanese language typewriters, multi-item switches, handy input machines and the like, or magnetic recording systems used in computer files, video files and the like, or microfilm readers or the like. Accordingly, the present invention will be explained by way of an example of the multi-purpose codeless input machine.

A conventional codeless input machine 4 (FIG. 1) comprises an input unit 1 and a film 2 on which a number of items 3 are recorded in matrix pattern. Each item recorded on the film corresponds to a respective information to be inputted. All of the items recorded on the film are grouped into a plurality of pages 5 having a lengthwise dimension L equal to that of the input unit, the transverse dimension of each page corresponding to the width of the film. In order to position a desired item 3 on the input unit 1 for inputting the information corresponding to the desired item, the film 2 can be moved by means of an appropriate film feeding device (not shown) incorporated into the input machine in both directions indicated by an arrow F such that the page 5 including the desired item 3 is aligned with the input unit 1. When the desired item 3 is energized by a pen-touch or key-push operation, a corresponding input signal is generated; said input signal selecting or designating a corresponding address among a plurality of addresses stored in a memory (not shown) through the medium of a control portion (not shown) in the input unit 1, thereby generating an output signal regarding the information corresponding to the desired item. When a new item to be inputted next is not included in the present page, the film must be moved to position a new page including said new item on the input unit 1.

In this conventional input machine, since the movement of the film is effected per "page", when the lengthwise dimension of the page is L and the moving speed of the film is V, it takes at least a time of L/V for changing from one page to the next. Particularly, if the first page is changed to the last page, when the total number of pages is N, it takes a long time of L/V (N−1). Accordingly, this conventional input machine has the disadvantage of inordinate time consumption for changing pages with the result that the efficiency of the inputting operation is reduced.

By increasing the moving speed of the film, the above drawback of the conventional input machine can be more or less eliminated. However, where that speed is increased, there is introduced another drawback because it is then difficult to accurately stop a desired page of the film in a predetermined position on the input unit.

SUMMARY OF THE INVENTION

An object of the present invention is to eliminate the above-mentioned drawbacks of the conventional input machines and to provide a tape driving apparatus capable of quickly and accurately selecting a desired tape among a plurality of tapes and positioning any portion of the selected tape in a predetermined station.

In order to achieve the above object, according to a preferred embodiment of the present invention, the tape driving apparatus comprises a plurality of rollers on each of which a corresponding tape is wound from one of its ends, means for selectively positioning a desired roller selected from among said rollers in a first predetermined station, and means for picking up the tape wound on the desired roller positioned in the first predetermined station and for drawing out said tape from the desired roller to a second predetermined station. In the case where the tape driving apparatus of the present invention is used with the multipurpose input machine, an input unit may be arranged between the first and second predetermined stations. By providing any tape winding means such as a roller at the second predetermined station, the amount of the tape drawn out from the corresponding roller may be increased.

DETAILED DESCRIPTION OF THE PREFERRED EMBODIMENTS

Figure 1:
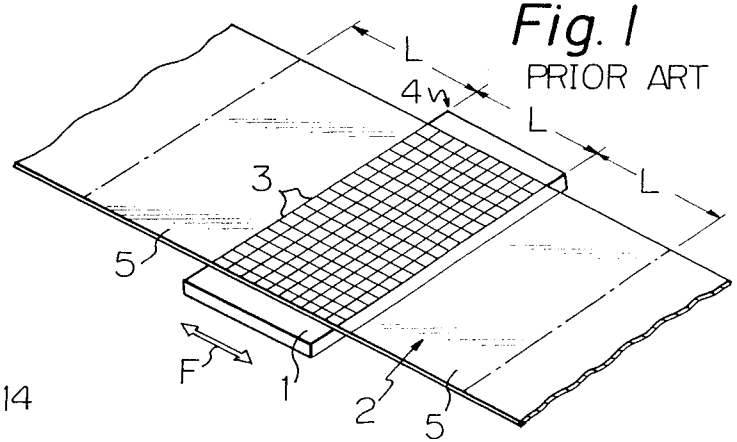
Fig. 1 PRIOR ART
FIG. 1 is a partial perspective view of a conventional codeless input machine.
Figure 2:
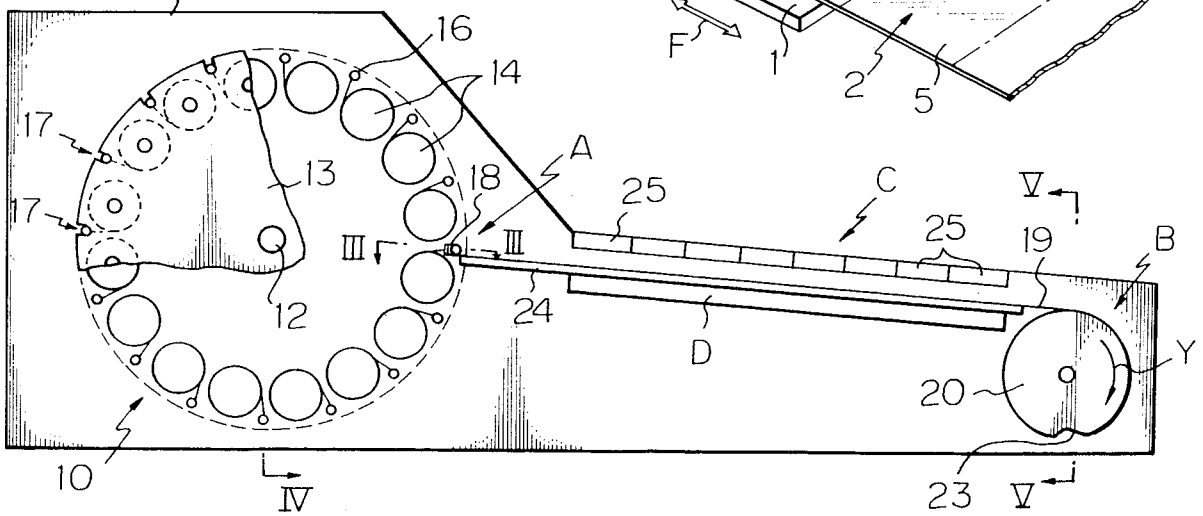
FIG. 2 is a schematic side view of a codeless input machine incorporating a tape driving apparatus according to an embodiment of the present invention and shows the internal construction of the machine.
Figure 3:
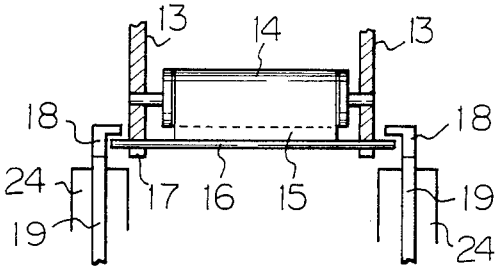
FIG. 3 is a partial sectional view taken along the line III—III of FIG. 2.
Figure 4:
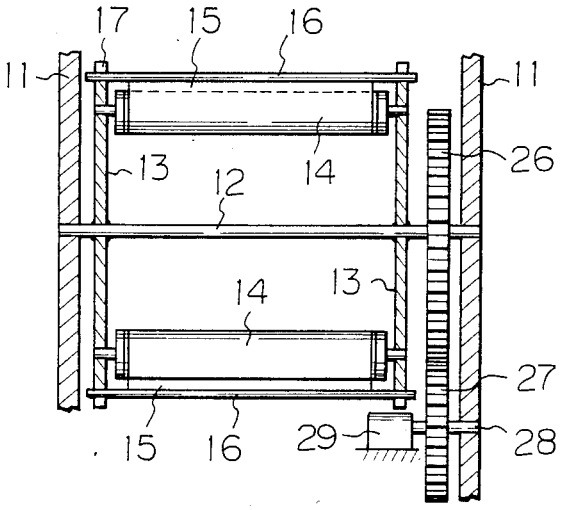
FIG. 4 is a sectional view taken along the line IV—IV of FIG. 2.
Figure 5:
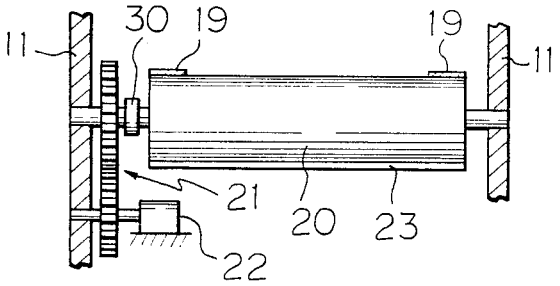
FIG. 5 is a sectional view taken along the line V—V of FIG. 2.

The present invention will now be described in detail with reference to the drawings showing an embodiment of the tape driving apparatus according to the invention. As shown in FIGS. 2–5, a tape driving apparatus according to the present invention is incorporated into an appropriate machine such as the codeless input machine shown in FIG. 2. The tape driving apparatus comprising a drum 10 rotatably mounted on a fixed frame 11 of the input machine. The drum 10 comprises a central shaft 12 (FIG. 4) rotatably supported by the machine frame 11, two end plates 13 fixed to the central shaft 12, and a plurality of rollers 14 extending parallel to each other and arranged in an annular pattern around the central shaft 12 and mounted rotatably between the end plates 13. On each roller 14 a corresponding tape 15 on which a plurality of items are recorded is wound from one of its ends. The other end (i.e. free end) of each tape 15 has a transverse bar 16 attached thereto, the bar 16 having a length greater than the width of the corresponding tape 15 such that both ends of the bar 16 protrude laterally from the tape. The end portions of each bar 16 are normally housed in corresponding slots 17 formed on the peripheral edges of the end plates 13.

A tape pick-up and drawing means is provided at a tape pick-up position (a first predetermined station) A (FIG. 2) in association with the drum 10. In an embodiment of the invention, the tape pick-up and drawing means (FIG. 3) comprises a pair of hooks or grippers 18 that are normally positioned rearwardly and laterally of the ends of the bar 16 which is attached to the free end of the tape 15 that is wound on the roller 14 which are positioned at the station A, and pulling members (for example, flexible strip) 19 which are connected to the hooks 18. A tape arrival position or tape winding position (a second predetermined station) B situated far from the tape picking-up position A includes a take-up reel 20 to which the other ends of the pulling members 19 are connected at the cylindrical end portions of the take-up reel 20. The take-up reel 20 (FIG. 5) is rotatably mounted on the machine frame 11 and can be rotated by any appropriate driving means such as a gear train 21 and a stepping motor 22. Therefore, when the take-up reel 20 is rotated in a clockwise direction indicated by an arrow Y (FIG. 2), the pulling members 19 are wound on the take-up reel, thereby drawing the tape 15 in the picking-up position A toward the tape arrival position B through the medium of the hooks 18 and the corresponding bar 16 engaged by said hooks. Preferably, when the bar 16 of the tape 15 has just arrived at the take-up reel 20 in the arrival position B, the bar is received in a longitudinal groove 23 (FIGS. 2 and 5) formed in the cylindrical surface of the second roller 20, whereby the tape can be wound on the second roller 20 without interference between the bar and the tape as the reel 20 is further rotated in the direction Y. For guiding and supporting the hooks 18 and the pulling members 19 between the stations A and B, support or guide members 24 are arranged substantially from the station A through the station B.

The input machine including the tape driving apparatus of the present invention is provided with an item indicating portion C between the tape pick-up station A and the tape arrival station B. The item indicating portion C includes, for example, a plurality of transparent switches 25 arranged in matrix pattern corresponding to the item matrix on the tape to be indicated in the indicating portion C. The input machine further includes an input unit D of known type arranged under the item indicating portion C. The tape being moved toward the arrival station B passes over the input unit D.

Means, which may be of any suitable kind, are provided for returning the drawn tape from the tape arrival station B to the tape picking-up station A. For example, said tape returning means may comprise an auto-return mechanism for a roller blind, incorporated into the interior of the roller 14, or may comprise any known selective driving mechanism including clutches, a gear train, electric motors and the like (not shown) arranged to cooperate with the shaft of the roller 14 and positioned at the pick-up station A, in such a way that the roller 14 is positively rotated by said driving mechanism to wind the corresponding tape onto said roller. Further, the tape can automatically return to the station A by providing an auto-return characteristic to the tape itself which is achieved by any known chemical treatment. Of course, the tape can be manually returned by rotating the roller 14 by hand.

Finally, means are provided for positioning a desired roller 14 in the tape pick-up station A by rotating the drum 10 step-by-step. For example, that positioning means may comprise a gear 26 fixed to the shaft 12 of the drum 10, a gear 27 meshed with the gear 26, and a stepping motor 29 having a drive shaft 28 on which the gear 27 is fixed. Of course, a desired roller (and, accordingly, a desired tape 15) can be manually positioned by rotating the drum 10 by hand.

The operation of the input machine illustrated in the drawings is as follows. At first, by depressing a key corresponding to a roller 14 desired to be positioned, selected among a group of keys arranged on a control panel (not shown), the drum 10 is rotated by a predetermined amount by means of a stepping motor 29 through a known selecting circuit (for example, including pulse counters, a comparison circuit, a coincidence circuit, pulse generators and the like), thereby positioning the desired roller 14 in the tape pick-up station A. Then, by actuating a stepping motor 22 (FIG. 5), the take-up reel 20 is rotated in the direction Y, with the result that the bar 16 associated with the desired or selected roller 14 is drawn up to the tape arrival station B through the hooks 18 and the pulling members 19. Thus, the tape 15 connected to the bar 16 is also drawn up to the station B. The position of the groove 23 on the take-up reel 20 is so selected that the bar 16 is received in the groove when the bar has just arrived at the station B. At this point, one page having on it a matrix of items that includes a desired item to be inputted, is positioned in the indicating portion or area C. Upon depression of the switch 25 corresponding to the desired item, a control portion in the input unit D reads out an input signal stored in an address corresponding to the desired item from a memory and outputs it in a known manner. Preferably, the longer tapes each includes a plurality of pages of item matrix and are used so that any page (among a plurality of pages in each tape) can be positioned in the indicating area C by rotating the second roller 20 by predetermined amounts. In this way, the number of items to be handled by the input machine can be markedly increased. In this case, since the bar is received in the groove 23 of the take-up reel 20, it does not interfere with the winding of the tape on the take-up reel.

After the inputting operation has been completed, a clutch 30 (FIG. 5) is disengaged so that the second roller 20 can be freely rotated, and the tape 15 is returned to the station A by the action of the above-mentioned tape returning means.

Then, a new inputting operation regarding a new item can be performed in the manner similar to the above-mentioned one.

Although the tape driving apparatus according to the present invention has been described in connection with the codeless input machine, it should be noted that the present invention is not limited to the input machine; namely, the tape driving apparatus of the present invention can be applied to various uses, according to the kind of the tape (tape, film, sheet and the like). For example, when the tapes are microfilms and a film reader is provided in place of the tape indicating portion C and the input unit D, the tape driving apparatus can be used as a microfilm reading system. Further, when magnetic tapes are used and one or more magnetic heads are provided in place of the tape indicating portion and the input unit, the tape driving apparatus can be utilized as a magnetic reading system. Furthermore, when maps are printed on the tapes, the tape driving apparatus can be used as an atlas or an automatic map searching system.

The present invention is not limited to an embodiment illustrated and described above. For example, in place of the hooks and the pulling members, a carriage movable between the stations A and B and, grippers mounted on the carriage for gripping the bar 16 associated with the tape 15 may be used.

This application is, therefore, intended to cover any variations, uses, or adaptions of the invention following the general principles thereof and including such departures from the present disclosure as come within known or customary practice in the art to which this invention pertains and fall within the limits of the appended claims.

I claim:

1. Tape driving apparatus comprising:

(a) a plurality of rollers, (b) each roller having a separate length of tape wound thereon with one end of the tape being free, (c) laterally protruding means carried by the free end of each tape, (d) a rotatable drum having the plurality of rollers mounted thereon in circular disposition about the drum's axis of rotation, each roller being independently rotatable relative to the drum, (e) selector means for causing the drum to turn whereby any of its rollers can be individually brought to a pick-up station, (f) an inputting unit having means for reading information on the tapes, the inputting unit having a reading zone, (g) means for engaging the means which protrude laterally from the free end of the tape on the roller at the pick-up station and drawing that tape through the reading zone to a second station, the laterally protruding means and the means with which it is engaged travelling paths on either side of the reading zone, (h) a take-up reel disposed at the second station, the take-up reel having means for engaging the laterally protruding means on the tape drawn to the second station, (i) means associated with the take-up reel for causing that reel to turn in the direction causing the tape to be wound on that reel, (j) means associated with each reel in the drum for rewinding the tape on the roller, and (k) means associated with the take-up reel for allowing that reel to rotate in the direction enabling the tape to be rewound on its roller.

2. The tape driving apparatus according to claim 1, wherein the laterally protruding means on the free end of each tape is a bar whose ends protrude laterally beyond the tape, and wherein the means for engaging those lateral protrusions and drawing the tape to a second station includes (1) hooks for engaging the laterally protruding ends of the bar on the free end of the tape, and (2) means for moving the hooks to the second station.

* * * * *